United States Patent [19]

Wade

[11] Patent Number: 4,764,985

[45] Date of Patent: Aug. 23, 1988

[54] GARMENT FOR A WHEELCHAIR OCCUPANT

[76] Inventor: Vicki J. Wade, 611 E. Washington St., Pittsfield, Ill. 62363

[21] Appl. No.: 48,891

[22] Filed: May 12, 1987

[51] Int. Cl.[4] ..... A41D 3/08

[52] U.S. Cl. ..... 2/88; 2/114; 2/DIG. 7; 2/243 R

[58] Field of Search ..... 2/88, 84, DIG. 7, 114, 2/69, 51, 243 B, 243 R

[56] References Cited

U.S. PATENT DOCUMENTS

| | | | |
|---|---|---|---|
| 1,636,122 | 7/1927 | Brown | 2/DIG. 7 |
| 2,717,390 | 9/1955 | Houze | 2/88 X |
| 3,727,238 | 4/1973 | Wolfson | 2/69 |
| 3,747,122 | 7/1973 | Goldberg | 2/69 X |
| 3,781,916 | 1/1974 | Vitol | 2/88 |
| 4,266,299 | 5/1981 | Beal | 2/51 |
| 4,280,227 | 7/1981 | Brock | 2/88 |
| 4,547,907 | 10/1985 | Netsky | 2/DIG. 7 |

*Primary Examiner*—H. Hampton Hunter

*Attorney, Agent, or Firm*—Joseph W. Holloway

[57] ABSTRACT

A poncho-type garment having a head opening in the center section thereof located nearer the garment's back marginal edge and having the corners thereof substantially relieved to provide back and front panels which are transversly narrower than the centersection. When worn by a seated wheelchair occupant, the back panel substantially conforms geometrically to the chair backrest, the front panel overlies the lap and thighs, and the centersection provides open sleeves which drape downwardly from the shoulders to the area of the chair armrests. The corner reliefs eliminate those portions of the garment which would otherwise be wadded inside the chair frame or left dangling outside.

8 Claims, 1 Drawing Sheet

GARMENT FOR A WHEELCHAIR OCCUPANT

BACKGROUND OF THE INVENTION

This invention relates to an improved protective garment to be worn by a person confined to a wheelchair due to illness or disability which prevents normal standing and walking. In some cases the intended wearer may also suffer partial or complete disuse of his upper body and arms due to paralysis or the presence of various immobilizing appliances such as casts or braces. Despite such severe disabilities, it is often necessary or desirable that the afflicted person be outdoors under weather conditions which necessitate an outer garment over the person's normal clothing to keep him comfortably warm.

Outer garments of the type worn by ambulatory persons, conventional overcoats for example, are unsuitable in the case of most persons confined to a wheelchair due to the extreme difficulty and discomfort encountered in putting a sleeved garment over the arms and shoulders and positioning the coat back of the posterior torso and under the legs.

Resorting to the use of blankets or similar body wraps to provide warmth in place of conventional coats or jackets is a common alternative. However, a loose wrap of this type tends to become displaced from the shoulders and upper body unless it is adequately secured by pins, or the like. Moreover, a substantial part of the bulk of the blanket is usually forcibly compressed between the wearer's body and back and sides of the wheelchair thereby causing discomfort due to unevenness in warmth and pressure. Unless a loose wrap placed about a wheelchair occupant is frequently checked by an attendant, chair movement may cause the wrap to be displaced thereby exposing the wearer and possibly permitting the wrap edges to dangle outside the wheelchair in dangerous proximity to the spokes of the chair wheels.

Yet another alternative to a conventional outer garment for those confined to a wheelchair is a well-known poncho. A typical poncho comprises a square or rectangular sheet of fabric having a centrally located opening through which the head protrudes. The material of the poncho surrounds the neck of the wearer and extends radially therefrom draping over the shoulders and downwardly over the arms and the front and back of the torso in a loose tent-like fashion. The downward extent of the draped material, hence the degree of body coverage, is determined by the selected dimensions of the poncho; however, the arms and hands are usually covered and the front and back of the torso are covered to an equal extent due to the central front-to-back location of the head opening.

While it is much easier to dress a disabled person in a poncho than in a conventional topcoat, substantial difficulties remain if that person is unable to rise so that the loosely hanging material of the poncho can be evenly draped about the arms and torso. In the case of a person seated in a wheelchair which has upstanding back and side structures proximate the seated body, the hanging poncho material creates problems which substantially diminish a poncho's utility in this special needs application. Because a poncho constructed of material suitably heavy to provide adequate warmth tends to be quite bulky, a delimma arises as to where to place those superabundant portions of the poncho which normally drape downwardly over the front and back of the torso and over the arms of a wearer. If the poncho is merely placed over the wearer's head and permitted to drape outside the backrest and armrests of the wheelchair, much of the insulating and warming effect of the garment is lost in areas of the body which are not intimately contacted by the poncho material. Furthermore, the poncho, dangling freely in a tent-like manner outside the chair framework, limits visibility of and access to the push handles on the chair backrest and the manual push rims of the wheels. Futhermore, this situation creates an extremely hazardous condition whereby the poncho edges could become entangled in the wheel spokes or be overrun by a wheel causing damage to the poncho or wheelchair or injury to the chair occupant.

An alternative suggested by the obvious problems which arise from placement of the poncho outside the wheel chair entails gathering the material which dangles outside the wheelchair and somehow placing it inside the wheelchair between the seated wearer and the back and sides of the seat framework. Because of the bulk of the gathered material and its tendency to become wadded across the lower back and sides of the wheelchair seat, the resultant discomfort of the wheelchair occupant due to localized pressure and overheating renders this alternative likewise unsuitable.

Should the intended wearer of a conventional poncho be required to wear shoulder restraining straps or similar means to maintain the torso erect against the backrest, the aforementioned limitations of a poncho as a special needs garment are further exacerbated.

SUMMARY OF THE INVENTION

Accordingly, the general object of this invention is to provide a poncho-type outer garment for a wheelchair occupant which is modified in configuration and construction so as to obviate the aforedescribed shortcomings of the prior art garments presently utilized for this purpose.

A principal object is to provide an improved poncho which can be fitted on a person seated in a wheelchair with minimum effort and discomfort on the part of the wearer and can be worn comfortably without becoming wadded under and between the wearer's body and the wheelchair seat, backrest and armrests. To this end, this invention contemplates modifications of a conventional four-sided poncho comprising narrowing and shortening of the back portion thereof to more nearly conform to the size and shape of the wearer's back as well as the vertical and horizontal dimensions of the backrest of the wheelchair. Shortening of the poncho back portion is accomplished by locating the head opening eccentrically nearer to the back marginal edge of the poncho. Substantial portions of both back corners of the poncho material are cut away to effect the required narrowing of the depending poncho back.

Another object is to provide a poncho which adequately covers the arms and upper legs of a seated wearer without dangling excessively or dangerously outside the wheelchair framework. To this end, the width of the intermediate poncho material overlying the shoulder area of a wearer is selected to promote the formation of laterally extending sleeve-like coverings which drape downwardly over the shoulders and arms essentially to the armrests of the wheelchair. Due to the eccentric location of the head opening nearer to the back edge of the poncho, the poncho front is somewhat longer than the back and drapes from the neck, down the chest and over the lap and legs to the area of the knees. Substantial cutouts are also provided at the front corners of the poncho material to narrow the width of the poncho from the lap area to the front marginal edge yet providing sufficent width to cover comfortably the tops and sides of the thighs while eleminating that surplus material which would otherwise dangle forwardly from the seat in the area of the chair wheels.

Yet another object of this invention is to provide an improved outer garment of the aforedescribed type whereby a person restrained in a wheelchair by shoulder straps or the like can be easily dressed in the garment by an attendant and can thereafter wear the garment with comfort and safety.

Still another object is to provide an improved method of fabricating a poncho from a rectangular sheet of fabric.

These and other features and objects of this invention and the manner of attaining them will become apparent and the invention will be best appreciated and fully understood by having reference to the following detailed description of embodiments of the invention taken in conjunction with the accompanying drawings.

DETAILED DESCRIPTION OF THE PREFERRED EMBODIMENTS OF THE INVENTION

Figure 1:
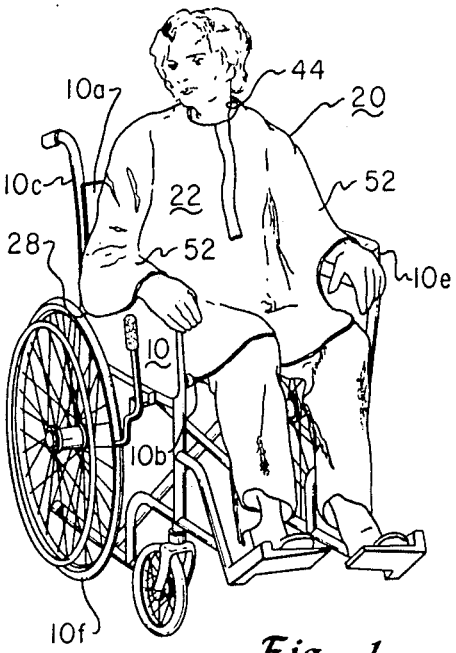
FIG. 1 is a perspective view showing a garment constructed in accordance with this invention worn by a person confined to a wheelchair.

A human figure depicted graphically in FIG. 1 in a typical wheelchair 10 is clothed in an improved poncho-type outer garment constructed in accordance with the teaching of this specification.

The head of the figure protrudes through an opening the perimetric edge of which closely surrounds the neck. From the neck, the poncho drapes laterally and downwardly over the chest, across the lap and thighs, terminating in a front marginal edge preferably somewhat below the knees. The back portion of the poncho, not seen in FIG. 1, extends downwardly from the posterior neck area covering the entire area of the wearer's back and terminating in a back marginal edge which preferably lies essentially on the line of intersection of the backrest and seat of the wheelchair. Stated otherwise, if the seated figure were standing, the back marginal edge would extend approximately across the middle area of the buttocks. A more complete description of the manner of fitting the poncho with respect to the figure and the structural elements of the wheelchair 10 will be hereinafter presented in detail.

Figure 2:
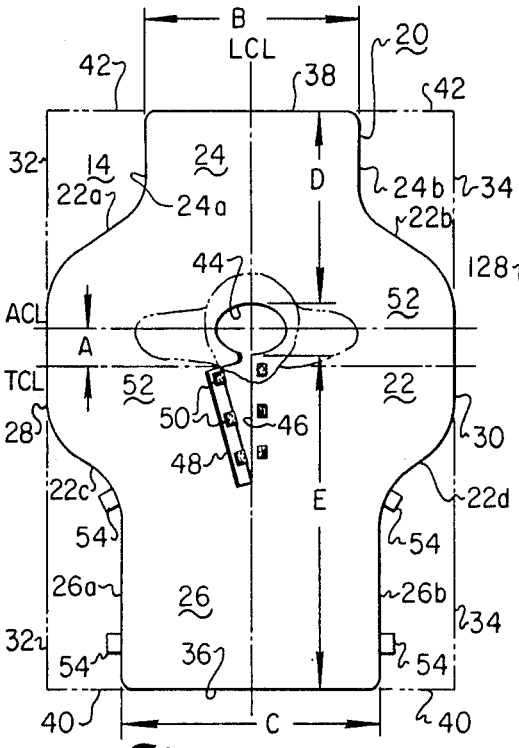
FIG. 2 is a plan view of the garment shown in FIG. 1 lying flat and indicating in phantom lines the marginal outline of a material sheet from which the garment is fabricated.

Turning now to the configuration and method of construction of the poncho, FIG. 2 illustrates the poncho laid flat. The straight intersecting phantom lines in FIG. 2 describe the rectangle shape of a fabric sheet 14 from which the poncho body, denominated in its entirety by numeral 20, may be fabricated by cutting. A secondary purpose of the phantom lines in FIG. 2 is to outline the marginal configuration of a conventional poncho having the same overall length and width as the improved poncho body 20 thereby contrasting the hereinafter described features of the present invention with respect to prior art garments of the same general type. Also shown in phantom lines near the middle of the poncho 20 is an outline of the head and shoulders of the figure depicted in FIG. 1 shown facing forwardly toward the front marginal edge 36 of the poncho.

Generally, the poncho body 20 comprises a middle or center section 22, a reduced back panel 24 and a reduced front panel 26. The midsection 22 corresponds in width to the transverse dimensions of the rectangular fabric sheet 14 from which the poncho is cut; and, the combined longitudinal dimensions of the midsection 22 and the front and back panels 24, 26 correspond to the longitudinal dimension of the sheet 14. The midsection and both front and back panels are symmetrical about the longitudinal centerline LCL of the poncho; however, for purposes to be described, the panels are transversely narrower than the midsection. The side marginal edges 28 and 30 of the midsection 22 register with the opposed side edges 32 and 34 of the sheet 14 while the end edges 36 and 38, respectively, of the front and back panels 24 and 26 register with the opposed end edges 40 and 42 of the sheet 14.

An elliptical aperture 44 in the midsection 22 has its middle located at the intersection of the poncho's longitudinal centerline LCL and line ACL which is parallel to the poncho's transverse centerline TCL, but displaced therefrom a distance A toward the marginal edge 38 of the back panel 24. As best shown in FIG. 2, a well-known placket 46 extends from the front perimetric edge of the aperture 44 toward the front panel 26 a sufficient distance to coact with the aperture to define an opening large enough to receive comfortably the head of the wearer. After the head is received through aperture 44, the placket 46 may be closed by means of an overlying flap 48 and interlocking pads 50 of loose pile fastening material secured to the flap 48 and poncho centersection 22, respectively. The size and shape of the aperture 44 is cutout so that, when the placket 46 is closed and the poncho is resting on the shoulders, the average sized neck is comfortably enclosed but not constricted.

An important structural feature of the present invention is the provision of a poncho having cutouts at each of its corners. The individual cutouts may be conveniently identified and denoted as occuring at the corner intersections of the marginal edges of the fabric sheet 14. Thus the front of the sheet displays cutouts 32-40 and 34-40 while the back cutouts occur at 32-42 and 34-42. As suggested above, the lines 32, 34, 40 and 42 may be thought of as the outline of a conventional rectangular poncho in order to appreciate the significant departures therefrom exhibited by the improved poncho shown in FIG. 2.

The back panel 24 is formed by cutouts 32-42 and 34-42 whereby the back panel 24 has like side marginal edges **24*a* and 24*b* and a width B. The cutout 32-42 also provides an S-curved transitional edge 22*a* merging with edges 24*a* and 28 of the back panel 24 and the midsection 22, respectively. Similarly, cutout 34-42 provides an S-curved transitional edge 22*b* merging with edges 24*b* and 30 of the back panel 24 and the midsection 22**, respectfully.

The front panel 26 is formed by cutouts 32-40 and 34-40 and has side marginal edges 26*a* and 26*b* and a width C. Cutout 32-40 provides an S-curved transitional edge 22*c* merging with edges 26*a* and 28 of the front panel 26 and the midsection 22, respectively, while cutout 34-40 provides an S-curned transitional edge 22*d* merging with edges 26*b* and 30 of the front panel 26 and the midsection 22, respectively.

One purpose of eccentrically locating the transverse centerline ACL of the aperture 44 a distance A from the poncho transverse centerline TCL is to provide a back dimension D between the back perimetric edge of aperture 44 and end edge 38 which is less than the front dimension E between the front perimetric edge of the aperture 44 and the front edge 36 of the front panel 26.

Figure 4:
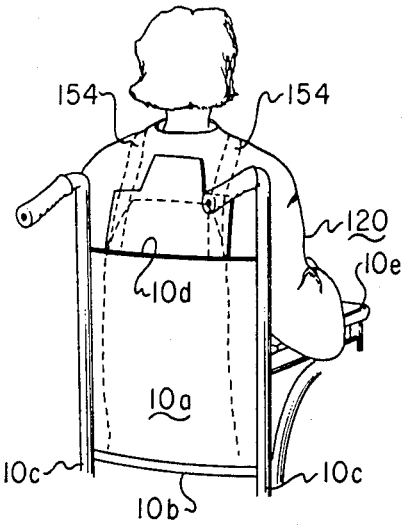

Referring to FIG. 4 which shows the rear construction of the wheelchair 10, the vertical, four-sided backrest 10*a* is generally defined by the spaced upright members 10*c*, its top horizontal edge 10*d* and the rear edge of seat 10*b*. The back of the poncho shown in FIG. 2 is fabricated in the aforedescribed manner so that the width B of the back panel 24 substantially corresponds to the horizontal dimension of the backrest 10*a* between members 10*c*, the length of side marginal edges 24*a* and 24*b* substantially corresponds to the vertical dimension of the backrest 10*a*, and the poncho's back dimension substantially corresponds to the vertical distance between the base of the figure's neck and the surface of seat 10*b*. Provision of substantial geometric similarity between the wheelchair backrest 10*a* and the back of poncho 20, assures that the posterior torso of the wearer is covered yet the back panel material can be comfortably and neatly received between the torso and the backrest without lumps or folds.

As noted above, the poncho's front dimension E is longer than its rear dimension D thereby providing adequate material to not only cover the anterior torso but also the lap area and the upper thighs of a seated chair occupant as illustrated in FIG. 1. The front panel width C and length of its side marginal edges 26*a* and 26*b* are preferrably somewhat greater than the corresponding dimensions of the back panel 24 in order to provide sufficient material to cover the lap area and to extend across the tops of the thighs and knees and to drape downwardly over the sides of the thighs approximately to the horizontal level of the chair seat 10*b*.

The preferred width of the midsection 22 between its side marginal edges 28 and 30 corresponds to the full width of the rectangular fabric sheet 14 and is selected so that the opposed side portions of the midsection extend laterally a substantial distance beyond the shoulders of an average size wearer of the poncho 20. This relationship of the poncho midsection 22 to the shoulders of the underlying human figure is illustrated in FIG. 2; and, FIG. 1 shows on a seated figure the resultant open, sleeve-like portions 52 which drape downwardly from the shoulders to cover loosely the front, sides and back of the arms lying on a pair of chair armrests 10*e*.

The poncho body 20 may be fabricated from any suitable material or combination of materials one preferred combination of materials being a durable corduroy outer fabric lined with natural or artificial fleece or fur. Quilted material filled with a thermal-insulating batting also furnishes the necessary protection for the poncho wearer. While the garment disclosed herein is well adapted to be fabricated from a single piece of fabric, the back and front panels 24 and 26 may be cut out individually and thereafter attached to the midsection 22.

Although not necessarily a component of the poncho construction in accordance with this invention, if desired, a hood, not shown, or similar covering for the head of the poncho wearer may be fastened about a portion of the back perimeter of aperture 44 in any well-known fashion.

Having described details of the construction and method of making a preferred embodiment of the invention, the manner of fitting the garment on a person confined to a wheelchair will be set forth. If the person is capable of rising, the poncho 20 is simply placed over the head and permitted to fall down over the shoulders and torso prior to seating in the wheelchair 10; however, fitting the garment on a seated person will be described to point out the salient advantages of the present invention in overcoming this more difficult circumstance.

The aperture 44, with placket 46 open, is fitted over the head with the back and front panels 24 and 26 properly oriented. The torso is then tilted slightly forwardly to whatever degree is comfortable for the wearer so that the back panel may be slipped downwardly from the neck between the posterior torso and the chair back 10*a*. Due to the substantial conformity of the poncho back and the chair back, this portion of garment 20 will be disposed entirely inside the chair arms 10*e*; and, back panel edge 38 will terminate at or near the surface of chair seat 10*b* thereby eliminating the need to disturb the wearer by lifting his hips to receive thereunder any excess material which otherwise would become folded or wadded behing the torso. This important feature of the invention makes it unnecessary to place any portion of the garment under the wearer thereby assuring that the seat surface will not become bumpy and uneven due to movement of the wearer and avoiding possible soiling of the underlying garment in the case of an incontinent user. Should the back panel width B be greater than the width of the torso of a seated chair occupant, the back panel material may be drawn slightly forwardly about the sides of the torso and hips for additional warmth in those areas.

As the garment is placed over the head, the opposed sleeve portions 52 of the midsection 22 will naturally cover the shoulders and tend to drape downwardly over the arms, as shown in FIG. 1. The lateral marginal edges 28 and 30 of these sleeve-like portions 52 may hang outside of and approximately even with the chair arm rests 10*e*. In the case of an armless wearer or if otherwise desired, the sleeve edges 28 and 30 may be convieniently tucked inside the armrests without significant wadding of bulky poncho material between the torso sides and the armrests. In any event the sleeve portion 52 are not long enough to permit the edges 28 and 30 to dangle in the area of the chair wheels 10*f*. Not only do the sleeves 52 cover the shoulders, but the downwardly depending portions thereof which terminate in the S-shaped curves 22*a*, 22*b*, 22*c* and 22*d* loosely overly the sides of the torso forward of and behind the upper arms. If the arms are positioned on the armrest 10*e*, as depicted in FIG. 1, the garment material in the area of the S-curves 22*c* and 22*d* will neatly overlie the forearms.

After the back panel 24 and the loose sleeves 52 are fitted in the manner described above, the midsection 22 is smoothed over the torso front and lap and the front panel 26 is drawn forwardly over the thighs to over-hang the knees to a degree determined by the size of the chair occupant. The sides of front panel 26 will overly the sides of the thighs and extend downwardly therebeyond whereby the depending material, if inside the chair, can be tucked slightly under the upper thighs and, if outside the chair, will hang down only to the sides of the knee area as seen in FIG. 1. In accordance with the present invention, the garment's front marginal edge 36 is narrowed by the provision of the aforedescribed cutouts 32-40 and 34-40 so that it is unnecessary to compress bulky material under the knees to prevent the front portion of the garment from dangling outside the chair and becoming entangled in the chair wheels 10*f*.

After the poncho 20 is fitted on the wearer, the placket 46 is closed to the extent desired by the fasteners 50. If more positive positioning of the front panel 26 is required, in the case of windy outdoor conditions, for example, tiedown loops 54 are sewn along the edges 26*a* and 26*b* of the front panel to provide means for attaching the front panel behind the legs or to an adjacent portion of the chair frame.

Figure 3:
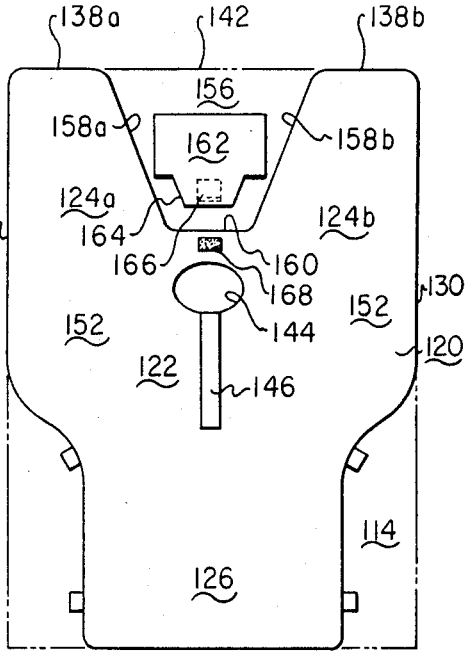
FIG. 3 is a plan view of a garment the back portion of which is a modification of the garment shown in FIGS. 1 and 2; and, FIG. 4 is a fragmentary rear plan view of a person seated in a wheelchair wearing the modified garment shown in FIG. 3.

The embodiment of this invention illustrated in FIGS. 3 and 4 displays the principal advantages of the poncho 20 shown in FIGS. 1 and 2 and is further adapted as an outer garment for a person required to wear restraining straps or the like to maintain the upper torso erect and against the backrest 10*a* of a wheelchair 10. Such straps 154 are commonly anchored on the chair back 10*a;* therefore, such straps would necessarily obstruct placement of the back of the poncho-type garment 20 over the posterior torso of a seated person so restrained. Generally, this invention obviates this problem by centrally bifurcating the back of the garment so that the back material can straddle the straps 154 and drape downwardly between the sides of the wearer's back and the chair backrest 10*a*.

With this general objective in mind, the structure of the modified poncho, shown in FIGS. 3 and 4 and denominated in its entirety by numeral 120, will be described in detail. The front panel 126 of the modified poncho 120 is constructed in the identical manner as the front panel 26 of the poncho 20 shown in FIG. 2; and, the head opening 144 and placket 146 are in the same location as their FIG. 2 counterparts. However, the back of the poncho 120 from the aperture 144 to the rear edge 142 of the fabric sheet 114 varies substantially from the back panel 24 of poncho 20. There are no counterparts to the cutouts 32-42 and 34-42 shown in FIG. 2. Instead, the lateral marginal edges 128 and 130 of the midsection 122 extend to the rear edge 142 of the sheet 114. A trapezoidal cutout 156 opens to the center of the rear edge 142 and has sloping sides defined by converging fabric edges 158*a* and 158*b* which intersect a fabric edge 160 longitudinally spaced from the back perimetric edge of aperture 144. The bifurcated material remaining between the edges 128 and 158*a* and between edges 130 and 158*b* define a pair of wing-like back panels 124*a*, 124*b* which taper toward and terminate in rear edges 138*a* and 138*b*, respectively. The dimension between the back perimetric edge of the aperture 144 and the rear edge 142 of the sheet 114 corresponds to dimension D of poncho 20; hence, the back panels 124*a* and 124*b* will drape downwardly from the back of the neck the same distance as does the back panel 24 of poncho 20.

For a purpose to be described, a rectangular closure panel 162 is formed from the fabric removed from the trapezoidal cutout 156. A tongue 164 extends upwardly from the closure panel 162 and carries a pad 166 of loose pile fastening material for attachment to a similar pad 168 fixed between the aperture 144 and the edge 160 of cutout 156.

The manner of placing the poncho 120 on a seated wearer is similar to that described in the case of poncho 20; moreover, the front panel 126, midsection 122 and sleeves 152 will fit in a manner corresponding with that shown in FIG. 1. However, the modified back of poncho 120 is draped downwardly over the shoulders until the edges 158*a* and 158*b* of the cutout 156 contact the shoulder straps 154 at or slightly above the point where the straps are affixed to the backrest 10*a*. The height of the trapezoidal cutout 156 from edge 142 to edge 160 and the degree of taper of relief edges 158*a* and 158*b* are selected so that, on an average size person, the material depending from the aperture 144 and shoulders will lie neatly against wearer's back without folding above the top 10*d* of the backrest. Since the torso of the wearer is pressed by the straps 154 into contact with the backrest 10*a*, the back panels 124*a* and 124*b* must be drawn downwardly inside tha armrests 10*e* and then slipped between the chairback 10*a* and the rounded side surfaces of the wearers back as shown in FIG. 4. Due to the taper of the panels 124*a* and 124*b*, their bulk is reduced in the area directly behind the center of the wearer's back; therefore, positioning these panels within the chair frame can be accomplished without significant wadding or folding of material between the chair and the torso. Since the edges 138*a* and 138*b* terminate near the level of the seat 10*b*, the modified back panels need not be placed under the hips nor wadded inside the chair frame.

With the back of the poncho 120 fitted on the wearer's back as aforedescribed, the closure panel 162 may be placed over that portion of cutout 156 extending above the top 10*d* of the chair backrest 10*a*. As viewed in FIG. 4 the bottom edge of the closure panel 162 registers with the top 10*d* of the backrest and the interlocking pads 166 and 168 secure the closure member in place to protect the otherwise exposed upper back of the wearer. If desired, the rectangular portion of closure member may be tucked inside the edges of the cutout 156 to lie inside the poncho back and under the straps 154.

While the described embodiments are well suited to fit a range of body sizes, the dimensions thereof can be scaled up or down during fabrication if the need arises to provide well fitting garments for large and small wheelchair occupants. If desired, the described garments can be made of lighweight fabric for wear indoors in place of normal clothing or as a light weight protective garment to be worn outdoors. These and other changes in specific details of the illustrative embodiments may be made without departing from the spirit and scope of the invention and the appended claims.

What I claim as my invention is:

1. In a poncho for a wearer seated in a wheelchair, the poncho having a flat body with a longitudinal centerline longer than its transverse centerline and having a midsection terminating at the side edges of said body, the improvement comprising:

a head-receiving aperture through the midsection located on said longitudinal centerline and displaced from said transverse centerline toward one end edge of the body;

the body including a back panel and a front panel extending longitudinally from the midsection, with each panel having transversly spaced side edges;

the back panel terminating longitudinally at said one end edge of the body and the front panel terminating longitudinally at the opposite end edge of the body;

the dimension of the front panel between the spaced side edges thereof being less than the transverse dimension of the midsection between the side edges of the body; and, the dimension of the back panel between the spaced side edges thereof being less than the dimension of the front panel between the spaced side edges thereof.

2. The invention defined in claim 1, wherein the displacement of said head-receiving aperture from said transverse centerline provides a front panel that extends longitudinally from the midsection a greater distance than does the back panel.

3. The invention defined in claim 1, wherein the body has S-curved transitional edges connecting the side edges of said body with the side edges of the panels.

4. The invention defined in claim 1, wherein:

the wheelchair has a generally horizontal seat and a generally vertical backrest;

the perimeter of the aperture is adapted to fit about the neck of a wearer;

the back panel has a longitudinal dimension from said perimeter to said one end edge substantially corresponding to the vertical distance from the posterior neck area of a seated wearer to the seat.

5. The invention defined to claim 3, wherein the front panel has a longitudinal dimension from said perimeter to said opposite end edge substantially corresponding to the distance taken from the anterior neck area of a seated wearer, over the chest and lap to the knee area.

6. The invention defined in claim 1, wherein the back panel is bifurcated by a cutout opening to said one end edge of the body.

7. The invention defined in claim 6, wherein the cutout is trapezoidal in shape and coacts with the side edges of the body and said one end edge to define a pair of spaced, tapered panels.

8. The invention defined in claim 6, together with a closure panel removably attachable to the back panel for closing a portion of the cutout.

* * * * *